US008292548B2

(12) United States Patent
Wishahy et al.

(10) Patent No.: US 8,292,548 B2
(45) Date of Patent: Oct. 23, 2012

(54) METHOD AND APPARATUS FOR IMPROVING THE LATERAL SUPPORT PROVIDED BY THE LEGS OF A JACK-UP DRILLING RIG

(75) Inventors: Momen A. Wishahy, Katy, TX (US); James N. Brekke, Houston, TX (US)

(73) Assignee: Transocean Offshore Deepwater Drilling Inc., Houston, TX (US)

( * ) Notice: Subject to any disclaimer, the term of this patent is extended or adjusted under 35 U.S.C. 154(b) by 45 days.

(21) Appl. No.: 12/472,179

(22) Filed: May 26, 2009

(65) Prior Publication Data

US 2010/0040418 A1 Feb. 18, 2010

Related U.S. Application Data

(60) Provisional application No. 61/055,752, filed on May 23, 2008.

(51) Int. Cl.
*E02B 17/00* (2006.01)

(52) U.S. Cl. ..... 405/224; 405/196; 405/197; 405/198

(58) Field of Classification Search ..... 405/196, 405/197, 198, 199, 200, 224
See application file for complete search history.

(56) References Cited

U.S. PATENT DOCUMENTS 1,867,030 A 7/1932 Roberts
2,940,265 A * 6/1960 Doody et al. ..... 405/227
3,011,467 A * 12/1961 Letourneau ..... 405/198
3,435,621 A * 4/1969 Johnson ..... 405/198
3,585,801 A 6/1971 Koehler
3,967,457 A * 7/1976 Lovie ..... 405/198
4,269,543 A * 5/1981 Goldman et al. ..... 405/198
4,307,977 A * 12/1981 Haney ..... 405/228
4,422,802 A * 12/1983 Choate ..... 405/198
4,431,345 A * 2/1984 Inoue ..... 405/196
4,648,752 A * 3/1987 Guy et al. ..... 405/227
4,854,778 A * 8/1989 Valenzuela ..... 405/195.1
5,224,798 A * 7/1993 Thomas ..... 405/198
5,248,003 A * 9/1993 Song et al. ..... 405/198
5,607,259 A * 3/1997 Thomas et al. ..... 405/198
6,705,802 B2 * 3/2004 Radwan ..... 405/196
6,869,252 B1 3/2005 Maini et al.

OTHER PUBLICATIONS

International Search Report issued Jul. 16, 2009 during the prosecution of International Application No. PCT/US2009/045171.
Written Opinion issued Jul. 16, 2009 during the prosecution of International Application No. PCT/US2009/045171.
International Preliminary Report on Patentability issued Nov. 23, 2010 during the prosecution of International Application No. PCT/US2009/045171.

* cited by examiner

*Primary Examiner* — Frederick L Lagman
(74) *Attorney, Agent, or Firm* — Fullbright & Jaworski, LLP

(57) ABSTRACT

The invention is directed to a method for increasing the overturning moment resistance of a jack-up drilling rig that includes the step of attaching at least one lateral leg support to at least one jack-up leg, wherein the jack-up leg is secured and has a lattice framework. The invention is also directed to a system and apparatus for increasing the overturning moment resistance of a support member with a lattice framework.

22 Claims, 6 Drawing Sheets

METHOD AND APPARATUS FOR IMPROVING THE LATERAL SUPPORT PROVIDED BY THE LEGS OF A JACK-UP DRILLING RIG

CROSS-REFERENCE TO RELATED APPLICATIONS

This application claims benefit of U.S. Provisional Application No. 61/055,752, filed on May 23, 2008, which is incorporated by reference herein in its entirety.

TECHNICAL FIELD

The invention relates in general to offshore drilling equipment, and in particular, the present invention provides an apparatus and a method for improving the lateral resistance of the legs of a jack-up drilling rig to movement in the surrounding soils. Additionally, the present invention provides apparatuses and methods for increasing the lateral resistance of a support member by attaching lateral support plates to the external faces, internal faces and/or vertices of the support member.

BACKGROUND OF THE INVENTION

In recent years, the need for additional oil, gas and other mineral resources has brought about increased activity in the exploration for and recovery of such resources from offshore locations. In order to perform the necessary exploration drilling, production drilling, and in some instances petrochemical-processing, it is necessary to provide a stable platform structure from which such activities can be conducted. At locations having small or marginal offshore reservoirs, the approach taken in recovering the minerals has been to erect mobile offshore jack-up platforms that permit a single platform structure to be utilized at several successive reservoirs.

A typical jack-up unit has a buoyant hull and has separate support legs that project upwardly from the hull during transport. Once the unit has reached the desired location, the support legs are lowered into contact with the ocean floor and the unit is raised to a level above the surface of the water. When operations are finished at a particular location, the structure can be moved to another site.

The increased activity in the exploration for and recovery of oil and gas from offshore locations and the mobility of jack-up rigs, has led to an increase in offshore drilling sites. This increase in offshore drilling sites increases the potential for offshore drilling equipment to be damaged due to environmental factors, especially in areas prone to revolving tropical storms such as the Gulf of Mexico and southeast Asia.

A jack-up unit may be lost or damaged by three main types of potential accidents, which include: (1) overturning when the weight of the unit cannot counterbalance the overturning moment due to environmental loads; (2) soil failure under a leg resulting either from sudden penetration of the leeward leg (punchthrough), or from sliding of the windward leg, due to low initial spud can (or mat) penetration; and/or (3) leg damage which usually occurs in the critical zone, at the leg/hull connection.

These three types of accidents are often closely linked. The essentially horizontal environmental loads (due to wave, wind and current) applied on the deck and legs of a unit in a jacked-up mode, generate a moment which tends to overturn the structure. Additionally, an excessive overturning moment may cause the sudden penetration of a leg which usually results in damage to the leg.

Leg members embedded in the soil with deep spud can penetration have an appreciable degree of lateral foundation resistance. For example, the increase in the overturning moment capacity may reach up to 40% in areas with at least 60 feet of penetration. This increase in the overturning moment is attributed to the lateral resistance of the chords and braces to movement in the surrounding soils. When the lateral foundation resistance is increased, the survivability of the jack-up rig improves. This increased survivability is especially beneficial in areas prone to revolving tropical storms such as the Gulf of Mexico and southeast Asia.

Therefore, there is a need to increase the lateral resistance of support members with an open lattice structure to movement in the surrounding soils. Specifically, there is a need to improve the overturning moment resistance of the legs of a jack-up drilling rig.

BRIEF SUMMARY OF THE INVENTION

The present invention is directed to a method, system and apparatus for increasing the overturning moment resistance of a jack-up drilling rig. In general, the present invention provides a method for increasing the overturning moment resistance of a jack-up drilling rig by attaching at least one lateral leg support to at least one jack-up leg, wherein the jack-up leg is secured and has an open lattice framework. In some embodiments, at least one lateral leg support is attached to an external face of the jack-up leg, an internal face of the jack-up leg, and/or a vertex of the jack-up leg. In some cases, the jack-up leg has a spud can attached to it. In other cases, the jack-up leg does not have a spud can attached and the jack-up leg is secured to the sea bottom by some other equivalent means.

In specific examples, at least one lateral leg support is attached to the spud can. In some embodiments, the spud can is embedded in the soil such that the lateral leg support is partially embedded in the soil. In other embodiments, the spud can is embedded in the soil such that the lateral leg support is substantially embedded in the soil.

Additionally, the present invention provides a drilling system that includes a drilling platform, at least one leg supporting the drilling platform. The leg has an open lattice framework and extends below the drilling platform and into the seabed, with at least one lateral support member being attached along the vertical length of the leg. In some embodiments, the lateral support member is attached to an external face of the leg, an internal face of the leg and/or a vertex of the leg. In additional embodiments, the lateral support member is partially buried in the seabed. In alternate embodiments, the lateral support member is totally buried in the seabed.

Also, the present invention provides for a leg of a drilling platform having a body with a top base and a bottom base, a spud can attached to the bottom base, and at least one lateral support plate attached along the vertical length of the body above the spud can. In some embodiments, the lateral support plate is attached to a at least one internal face, at least one external face and/or at least one vertex of the leg. In some cases, the lateral support plate is partially buried when the spud can is embedded in a seabed. In other cases, the lateral support plate is completely buried when the spud can is embedded in the seabed.

Additionally, the present invention provides an apparatus for increasing the overturning moment resistance of a support member with an open lattice framework that includes a plurality of vertical members wherein the plurality of vertical members are mutually parallel and spaced apart laterally to define the edges of a polyhedron in which the support member is configured. At least one lateral leg support is attached along a vertical length of the support member, wherein the support member is secured and is characterized by a plurality of vertical support members, a plurality of horizontal support members and/or a plurality of diagonal support members that form the open lattice framework. The plurality of vertical members are interconnected by the plurality of horizontal support members that extends between a pair of vertical members thereby forming a face. The plurality of vertical members are further interconnected by the plurality of diagonal support members. In some cases, the polyhedron is a prism. In specific examples, the prism has three, four, five, six, seven, eight, nine or ten edges. In some additional and/or alternate embodiments, the plurality of support members form a system of internal faces and the lateral support member is attached to at least one internal face. In some additional and/or alternate embodiments, the plurality of support members form a system of external faces and the lateral support member is attached to at least one external face. In some additional and/or alternate embodiments, the lateral support member is attached to at least one vertices of the support member.

In some examples, at least one lateral support member is partially and/or completely embedded in a seabed. In specific embodiments, a combination of at least two lateral support members are attached to the support member wherein at least one lateral support member has various horizontal widths throughout the length of the lateral support member.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1A:
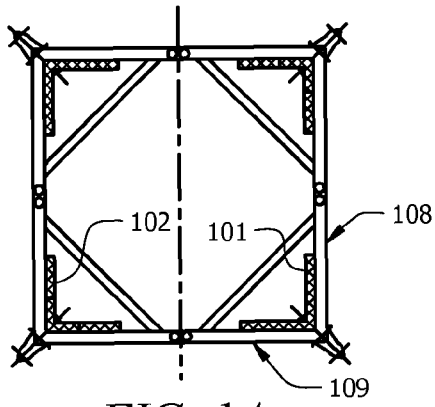
FIG. 1A shows top plan view of a four chord jack-up leg with lateral leg support members attached to the vertices of the leg.

There are many different jack-up platforms in use today. Jack-up platforms or units are divided into two main categories according to the structure of the legs and foundation. The first category is mat-supported jack-ups which rest on mat footing which connects all the legs together. The second category is independent lattice-leg jack-up units which are supported on spud cans. In some cases, the legs of some small units are not equipped with spud cans. The subject invention is particularly relevant to lattice-leg jack-up units which are supported on spud cans.

Prior art jack-up-type offshore platforms have typically utilized a trussed leg structure of triangular or other polygonal cross-sectional configurations. The leg structure comprises a plurality of cylindrical and non-cylindrical column members that are mutually parallel and spaced apart laterally to define the corners of the geometrical shape in which the leg structure is configured. The column members are interconnected by crossbracing that extends between adjacent column members, making the leg a unitary structure.

As used in the specification, "a" or "an" means one or more. As used in the claim(s), when used in conjunction with the word "comprising", the words "a" or "an" mean one or more. As used herein, "another" means at least a second or more.

The term "polyhedron" and/or "polygonal" as used herein refers to a geometric object with flat faces and straight edges. In general, the support members of the jack-up rig are in the geometrical shape of a polyhedron, and in particular a prism with an open lattice structure. However, the invention applies to all leg shapes including circular legs.

The term "prism" as used herein refers to a figure whose bases or ends have the same size and shape and are parallel to one another, and each of the sides of the prism is a parallelogram. For example, a triangular prism has a base in the shape of a triangle, a rectangular prism has a base in the shape of a rectangle, a pentagonal prism has a base in the shape of a pentagon, etc. In most cases, the support members are triangular, rectangular or square prisms.

The edges of the prism correspond to the chords of the support structure. The chords of the support structure are vertical members that are mutually parallel and spaced apart laterally to the skeletal framework of the support structure.

The braces of the support structure are horizontal and diagonal support members that connect one chord to another. Together, the plurality of vertical members, the plurality of horizontal support members and/or the plurality of diagonal support members form the open lattice framework of the support structure.

The term "face" as used herein refers to the plane created by two chords of the support structure. The term "exterior face" as used herein refers to the place created by two adjacent chords. The term "interior face" as used herein refers to the plane created by two non-adjacent chords.

The term "lattice" as used herein refers to open framework made of strips of metal, wood, or similar material overlapped or overlaid in a regular, usually crisscross pattern.

The term "vertex" and/or "vertices" as used herein refers to the corner or intersection point of one or more faces.

In general, the present invention provides a method, system and apparatus for increasing the overturning moment resistance of a support member. The method for increasing the overturning moment resistance of a jack-up drilling rig includes the step of attaching at least one lateral leg support to at least one jack-up leg, wherein the jack-up leg is secured and has an open lattice framework. The method further includes attaching at least one lateral leg support to an external face of the jack-up leg, an internal face of the jack-up leg, and/or a vertex of the jack-up leg. The jack-up leg can have a spud can attached to is wherein at least one lateral leg support is attached to the spud can.

The inventive drilling system includes a drilling platform and at least one leg supporting the drilling platform, wherein the leg has an open lattice framework and extends below said drilling platform and into the seabed. At least one lateral support member is attached along the vertical length of the leg. The lateral support member is attached to an external face of the leg, an internal face of the leg and/or a vertex of the leg. The lateral support member can be partially buried in the seabed or the lateral support member can be totally buried in the seabed.

An example of a support member with an open lattice structure is the leg of a jack-up drilling rig. When an open lattice structure is embedded in the soil, the chords and braces provide some resistance to movement in the surrounding soils. Once the lateral leg support is attached to the support member, there is an increase in the lateral resistance to movement in the surrounding soils that results from the increase in projected lateral area. This increase in resistance to lateral movement in the surrounding soils increases the corresponding overturning moment resistance.

In general, the lateral leg supports are constructed of plates reinforced or stiffened with angle stiffeners. For example, the plates may be steel plates or corrugated sheets made of the appropriate material and strength to resist the soil loads. The lateral leg supports are then attached to the lattice structure of the support member. In some cases, the lateral leg supports are welded to the lattice structure. In other cases, the lateral leg supports are attached using brackets.

The overturning moment resistance may be increased by attaching the lateral support member anywhere along the length of the support member. The lateral support member should be at least partially embedded to be effective. However, the placement of the lateral support members will typically be a design issue based on the location of the of the jack-up unit, the condition of the ocean floor and other environmental factors. In some cases, the attached leg support member is attached to the jack-up leg so that the leg support member is fully embedded in the soil. In other cases, the attached lateral leg support member is attached so that the leg support member is partially embedded in the soil. There may be more than one lateral leg support member attached along the length of the jack-up leg. In some examples, the lateral leg support member may be attached to the spud can. In the case where there is no spud can attached to the jack-up leg, the lateral leg support member may be attached to the secured portion of the jack-up leg. In some instances, more support members will be placed on one leg than other. For example, in situations where the jack-up units are positioned with respect to the prevailing wind/wave direction, different legs may have different support member/plate requirements. The angles of placement of the support members can be right angles or oblique angles. Whichever angle is used, the support members are positioned in a symmetric way so as to resist the environmental loads from all directions. The optimal positioning of the support members will be a design issue depending upon the location of the unit, the condition of the ocean floor and other environmental factors.

In certain circumstances, the addition of the lateral leg support member may impose a lateral load upon the support member or jack-up leg. To account for this increase of lateral load imposed by the lateral leg support member, additional chords and braces may be added to the support member for additional reinforcement.

The lateral leg support members may be attached in a variety of configurations. The variety of configurations detailed herein are exemplary. The leg support members can be welded or bolted to the jack-up legs, they can be fixed on the legs or be removable. The skilled artisan would readily recognize that various combination of configurations and configurations not listed in the examples can be made without departing from the spirit and scope of the invention.

FIG. 1A shows a four chord jack-up leg with lateral leg support members attached to the vertices of the leg. Although, FIG. 1A shows lateral leg support members 101, 102 attached to all four vertices, it is not necessary to attach lateral leg support members to all of the vertices. In some aspects of the present invention, lateral leg support members 101, 102 are attached to at least one vertex. For example, a vertex is formed at the intersection of horizontal support members 108 and 109.

Figure 1B:
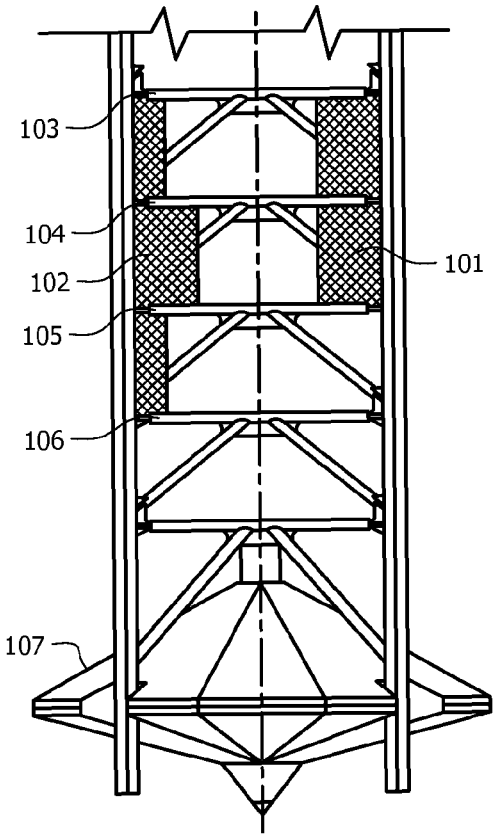
FIG. 1B shows a partial side plan view of a four chord jack-up leg with lateral leg support members attached to the vertices of the leg.

FIG. 1B shows a four chord jack-up leg with lateral leg support members, 101 and 102, attached to the vertices of the leg. As shown in FIG. 1B, the lateral support members may span at least two or more horizontal, diagonal and/or vertical support members. For example, the lateral support member 102 spans from the horizontal support member 103 to the horizontal support member 106 and the lateral support member 101 spans from the horizontal support member 103 to the horizontal support member 105.

Additionally as shown in FIG. 1B, the lateral support member may span various horizontal widths. For example, the lateral support member 102 between the horizontal support members 103 and 104 is of a different horizontal width in comparison to the width of the same lateral support member between horizontal support members 104 and 105. In some cases, the horizontal width of the lateral support member is same throughout the entire length of the lateral support member. Also, FIG. 1B shows an example of a jack-up leg with a spud-can 107 attached to the bottom of the leg.

Figure 2A:
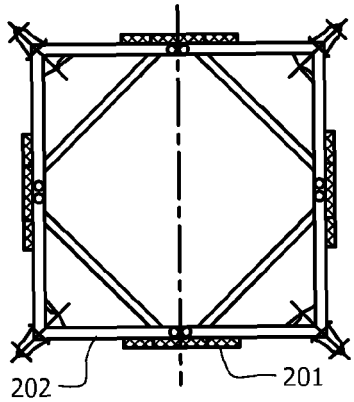
FIG. 2A shows top plan a four chord jack-up leg with lateral leg support members attached to the external faces of the leg.
Figure 2B:
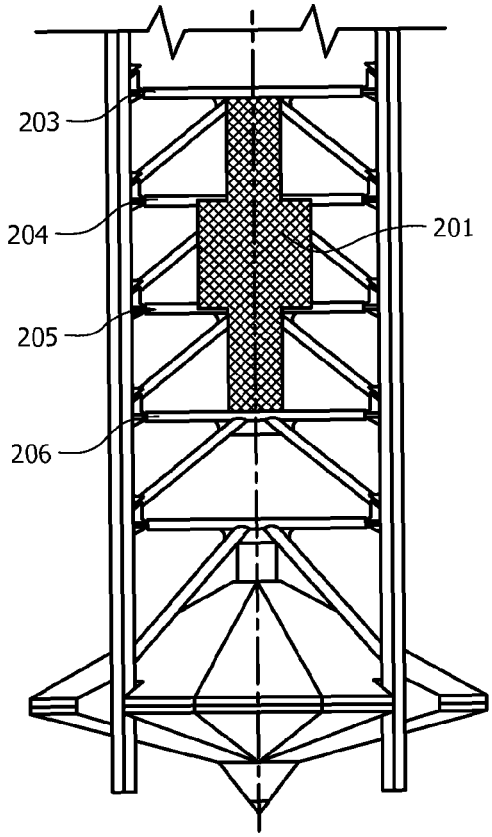
FIG. 2B shows a partial side plan view of a four chord jack-up leg with lateral support members having various horizontal widths throughout the vertical length of the lateral support member.

FIG. 2A shows a four chord jack-up leg with lateral leg support members attached to the external faces of the leg. In general, the lateral support member 201 is attached to at least one face 202 of the jack-up leg. As shown in FIG. 2A, the lateral support member 201 is attached to all four faces of the jack-up leg. Additionally, FIG. 2B shows a four chord jack-up leg with a lateral support member spanning from the horizontal support member 203 to the horizontal support member 206 and the lateral support member having various horizontal widths throughout the vertical length of the lateral support member. For example, the lateral support member 201 between the horizontal support members 203 and 204 is of a different horizontal width in comparison to the width of the same lateral support member between horizontal support members 204 and 205. In some cases, the lateral support member has the same horizontal width throughout the vertical length of the lateral support. The lateral support members may span at least two or more horizontal, diagonal and/or vertical support members.

Figure 3A:
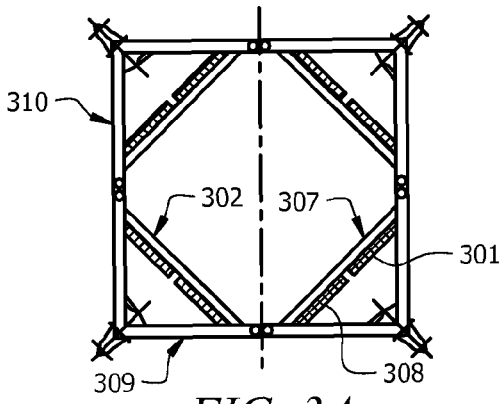
FIG. 3A shows a top plan view of a four chord jack-up leg with lateral leg support members attached to the internal faces of the leg.

FIG. 3A shows a four chord jack-up leg with lateral leg support members attached to the internal faces of the leg. An internal face, 302 or 307, of the jack-up leg is created when diagonal support members form an internal plane. As shown in FIG. 3A, an internal plane 302 is created by diagonal support members that substantially bisect two adjacent exterior planes, 309 and 310. Also, this example shows a plurality of lateral leg support members, 301 and 308, attached to an internal face 307 of the jack-up leg. In this example, each internal face contains at least one lateral leg support member. The lateral support members may span at least two or more horizontal, diagonal and/or vertical support members.

Figure 3B:
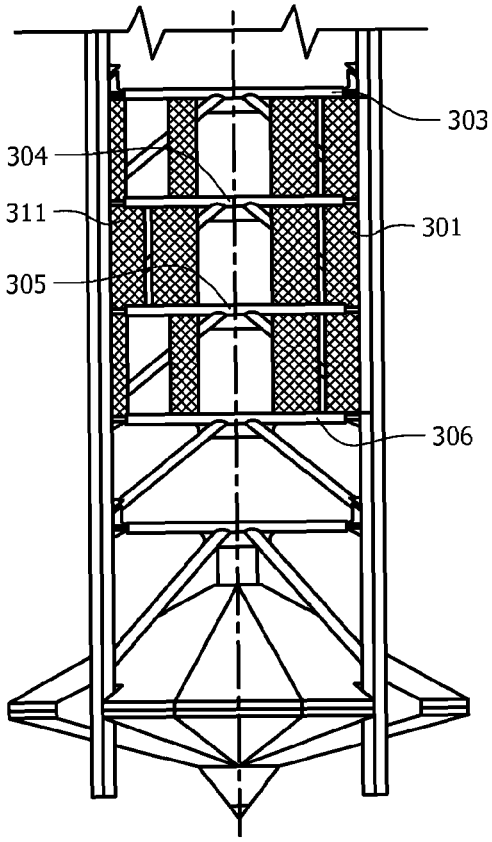
FIG. 3B shows a partial side plan view of a four chord jack-up leg with a combination of lateral support members attached to the internal faces of the leg.

FIG. 3B shows a four chord jack-up leg with a combination of lateral support members attached to the internal faces of the leg. In some cases, the combination of lateral support members attached to the internal face of the support member substantially span the entire width of the internal face. In FIG. 3B, the lateral support member 301 spans from horizontal support member 303 to horizontal support member 306. The lateral support member 311 between the horizontal support members 303 and 304 is of a different horizontal width in comparison to the width of the same lateral support member between horizontal support members 304 and 305. The lateral support member 301 has the same horizontal width throughout the vertical length of the lateral support. The lateral support members may span at least two or more horizontal, diagonal and/or vertical support members.

The lateral support member spans at least two horizontal, diagonal and/or vertical support members. In some cases the lateral support member spans between 2 and 4, 2 and 5, 2 and 6, 2 and 7, 2 and 8, 2 and 9, 2 and 10, 2 and 15, 2 and 20, 2 and 25, 2 and 30, 2 and 40, 2 and 50, 2 and 75, 2 and 100, 2 and 150, 5 and 10, 5 and 15, 5 and 20, 5 and 25, 5 and 30, 5 and 40, 5 and 50, 5 and 60, 5 and 75, 5 and 100, 5 and 125, 5 and 150, 10 and 15, 10 and 25, 10 and 40, 10 and 50, 10 and 75, 10 and 100, 10 and 125, 20 and 30, 20 and 40, 20 and 50, 20 and 60, 20 and 75, 20 and 100, 20 and 125, 20 and 150, 40 and 50, 50 and 60, 60 and 70, 70 and 80, and/or 80 and 90 horizontal, diagonal and/or vertical support members.

Figure 4A:
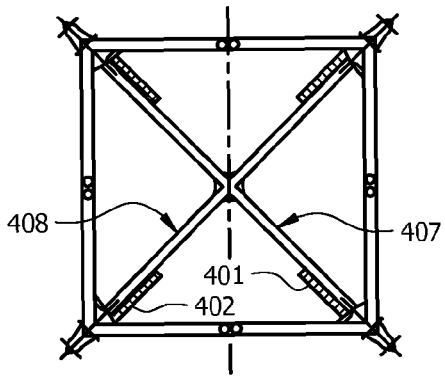
FIG. 4A shows a top plan view of a four chord jack-up leg with a plurality of lateral leg support members attached to the leg's internal faces.
Figure 4B:
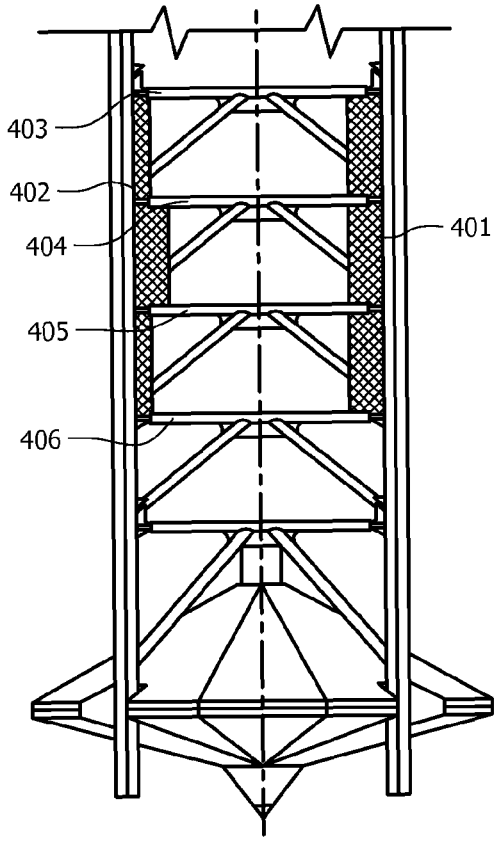
FIG. 4B shows a partial side plan view of a combination of lateral support members with various horizontal widths attached to the internal faces of the a jack-up leg.

FIG. 4A shows a four chord jack-up leg with a plurality of lateral leg support members attached to the leg's internal faces. In this example, the leg's internal face 407 is created by horizontal support members or diagonal support members that bisect non-adjacent vertices. Lateral support member 401 is attached to internal face 407 and lateral support member 402 is attached to internal face 408. FIG. 4B shows a combination of lateral support members with various horizontal widths attached to the internal faces of the a jack-up leg. The lateral support member 402 between the horizontal support members 403 and 404 is of a different horizontal width in comparison to the width of the same lateral support member 402 between horizontal support members 404 and 405. The lateral support member 401 that spans from horizontal support member 403 to horizontal support member 406 has the same horizontal width throughout the vertical length of the lateral support. The lateral support members may span at least two or more horizontal, diagonal and/or vertical support members.

Figure 9:
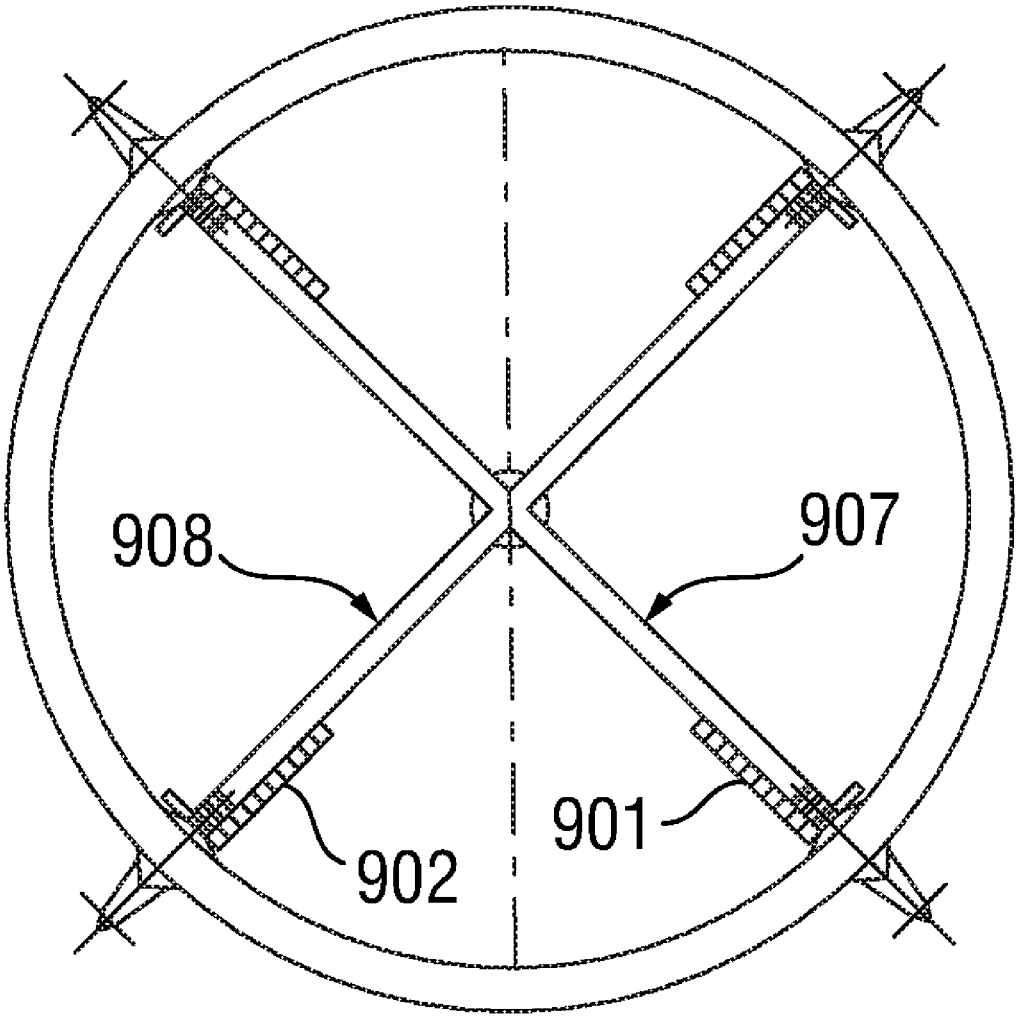
FIG. 9 shows a top plan view of a circular jack-up leg with a plurality of lateral leg support members attached to the leg's internal faces.

Alternatively, FIG. 9 shows a circular jack-up leg with a plurality of lateral leg support members attached to the leg's internal faces. In this example, the leg's internal face 907 is created by horizontal support members or diagonal support members that bisect non-adjacent vertices. Lateral support member 901 is attached to internal face 907 and lateral support member 902 is attached to internal face 908.

Figure 5A:
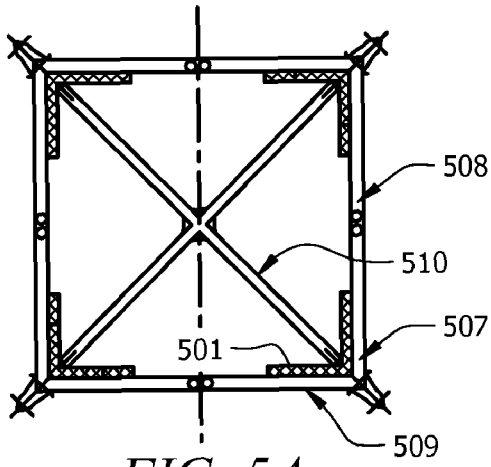
FIG. 5A shows a top plan view of a four chord jack-up leg with a plurality of lateral leg support members attached to the vertices of the jack-up leg.

FIG. 5A shows a four chord jack-up leg with a plurality of lateral leg support members attached to the vertices of the jack-up leg. A vertex is created by the intersection of horizontal support member 508 with the horizontal support member 509. Lateral support member 501 is attached to the vertex created by horizontal support members 508 and 509. The lateral leg support 501 is bisected by a horizontal support member or a diagonal support member, 510.

Figure 5B:
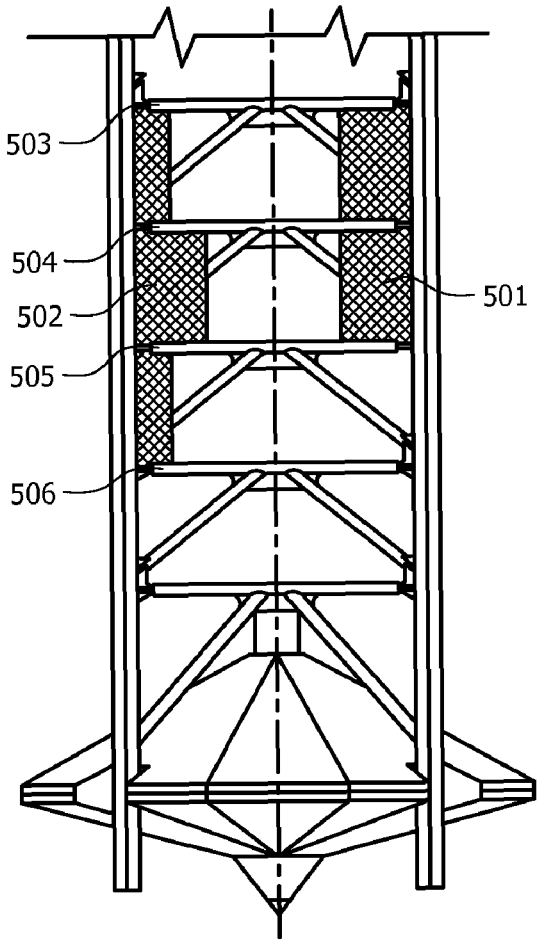
FIG. 5B shows a partial side plan view of a combination of reinforced lateral support members with various horizontal widths attached to the vertices of a jack-up leg.

FIG. 5B shows a combination of reinforced lateral support members with various horizontal widths attached to the vertices of a jack-up leg. The lateral support member 502 between the horizontal support members 503 and 504 is of a different horizontal width in comparison to the width of the same lateral support member 502 between horizontal support members 504 and 505. The lateral support member 501 that spans from horizontal support member 503 to horizontal support member 506 has the same horizontal width throughout the vertical length of the lateral support.

Figure 6A:
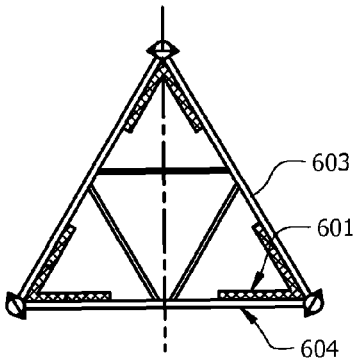
FIG. 6A shows a top plan view of a three chord jack-up leg with a plurality of lateral leg support members attached to the vertices of the jack-up leg.

FIG. 6A shows a three chord jack-up leg with a plurality of lateral leg support members attached to the vertices of the jack-up leg. A vertex is created at the intersection of support members 603 and 604. Lateral support member 601 is attached to the vertex created by support members 603 and 604. In this example, the lateral leg support members are attached to all three vertices. In other cases, the lateral leg support member is attached to at least one vertex. The lateral support members may span at least two or more horizontal, diagonal and/or vertical support members.

Figure 6B:
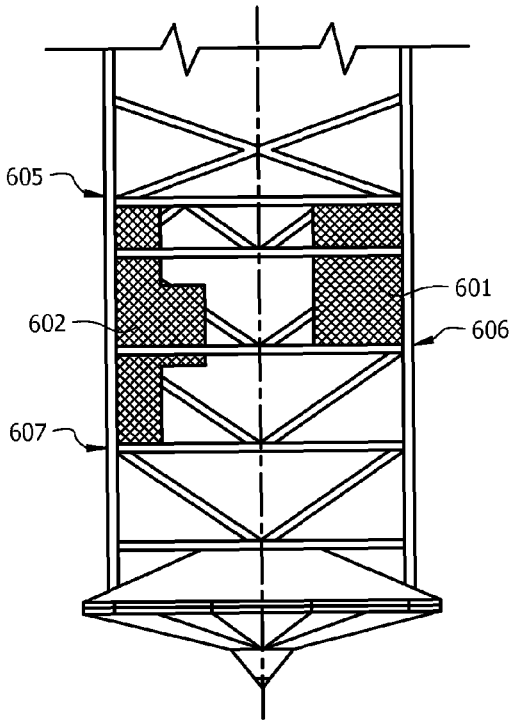
FIG. 6B shows a partial side plan view of a combination of lateral support members with various horizontal widths attached to the vertices of a jack-up leg.

FIG. 6B shows a combination of lateral support members with various horizontal widths attached to the vertices of a jack-up leg. The lateral support member 602 that spans from horizontal support member 605 to horizontal support member 607 varies in horizontal width throughout the length of the lateral support member. The lateral support member 601 that spans from horizontal support member 605 to horizontal support member 606 does not vary in horizontal width throughout the length of the lateral support member. The lateral support members 601 and 602 vary in length and in horizontal width with respect to each other. The lateral support members may span at least two or more horizontal, diagonal and/or vertical support members.

Figure 7A:
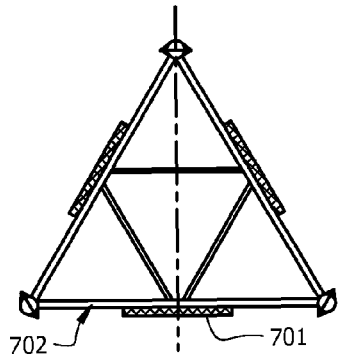
FIG. 7A shows a top plan view of a three chord jack-up leg with lateral leg support members attached to each external face of the leg.
Figure 7B:
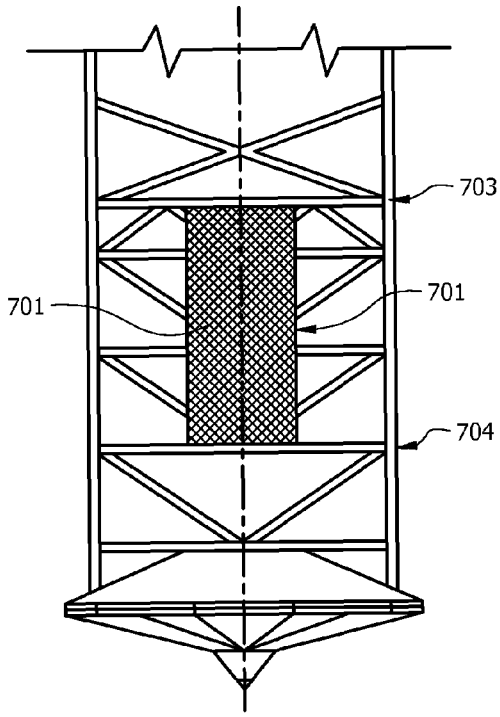
FIG. 7B shows a partial side plan view of a lateral support member attached to at least one face of a three chord jack-up leg.

FIG. 7A shows a three chord jack-up leg with lateral leg support members attached to each external face of the leg. The lateral leg support member 701 is attached to the external face 702 of the jack-up leg. In other examples, the lateral leg support member is attached to all external faces and/or at least one external face of a support member. In other examples, the lateral leg support is attached to at least one internal face of a support member with three chords. The internal faces of the support member with three chords may be created using horizontal support members and/or diagonal support members that intersects two adjacent external faces of the support member. FIG. 7B shows a lateral support member attached to at least one face of a three chord jack-up leg. The lateral support member 701 that spans from horizontal support member 703 to horizontal support member 704 is attached to the jack-up leg and has the same horizontal width throughout the length of the lateral support member. In some cases, the lateral support member has various horizontal widths throughout the length of the lateral support member. The lateral support members may span at least two or more horizontal, diagonal and/or vertical support members.

Figure 8:
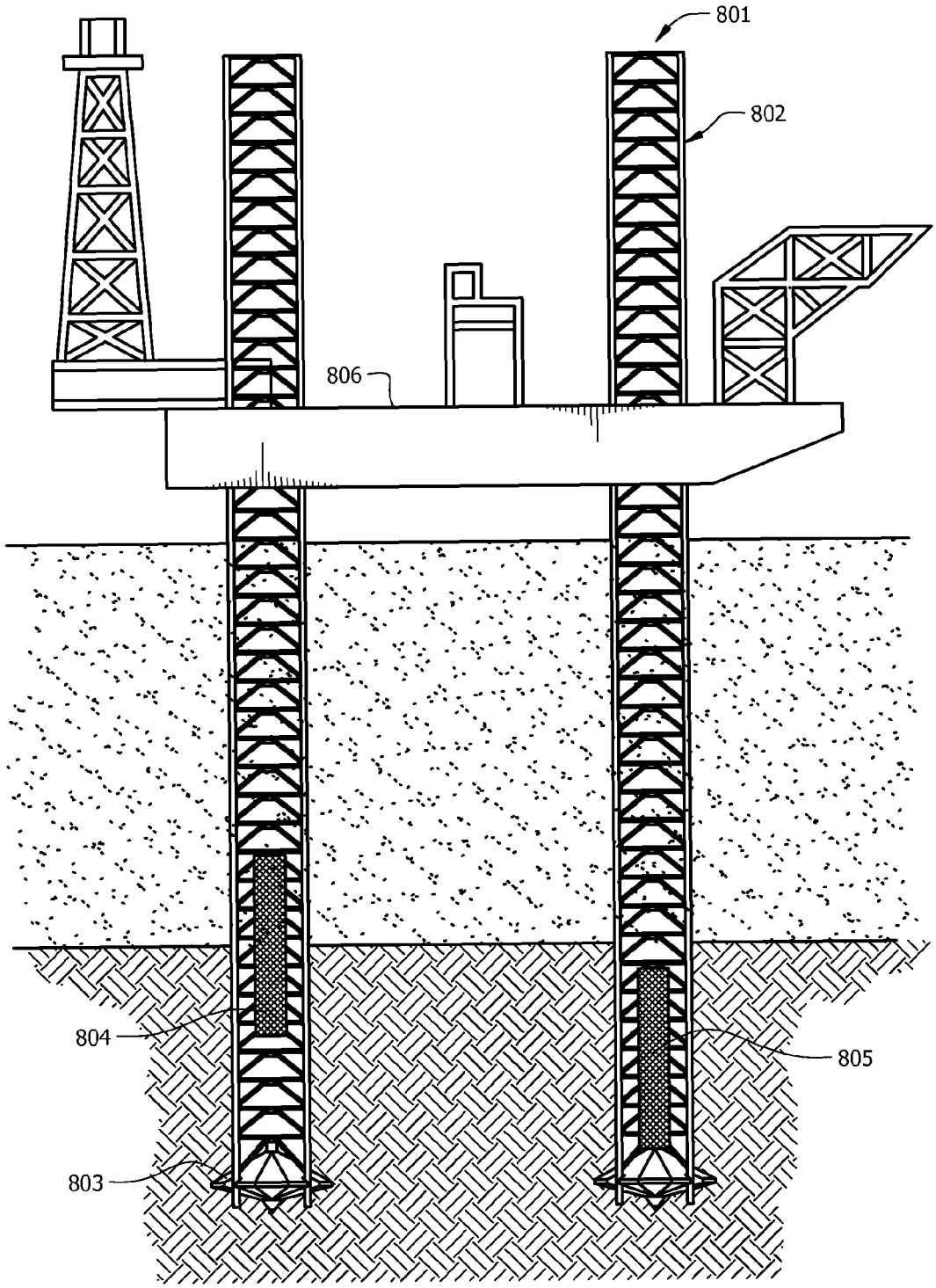
FIG. 8 illustrates a drilling system that includes a platform and jack-up legs.

FIG. 8 shows a drilling system that includes a platform 806 and jack-up legs. Specifically, FIG. 8 shows a jack-up drilling rig in the jacked-down position with a portion of the body of the jack-up leg 802 embedded into the seabed. The body of the jack-up leg is limited in vertical length by a top base 801 and a bottom base 803 with the top base and the bottom base having the same geometrical shape. In some cases, the bottom base has a spud-can attached. In other cases, the bottom base does not have a spud-can attached. Additionally, FIG. 8 shows a plurality of lateral support members 804 and 805. The lateral support member 804 is partially embedded in the sea bottom and the lateral support member 805 is fully embedded in the sea bottom.

It is noted that the application of the invention is not restricted to a certain number of legs on which a marine structure is being supported. Although most of the marine structures are supported by more than three legs, mono-leg structures do also exist.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for increasing the overturning moment resistance of a jack-up drilling rig comprising the step of:

attaching at least one lateral leg support to a face of a jack-up leg, wherein the jack-up leg is secured and has an lattice framework, and wherein the lateral leg support partially spans the face of the jack-up leg.

2. The method of claim 1, wherein at least one lateral leg support is attached to an external face of the jack-up leg, an internal face of the jack-up leg, and/or a vertex of the jack-up leg.

3. The method of claim 2, wherein the jack-up leg has a spud can attached to it.

4. The method of claim 1, wherein the at least one lateral leg support member spans at least one or more horizontal, diagonal and/or vertical support members.

5. The method of claim 1, wherein the lateral leg support is partially embedded in the soil when the jack-up is positioned for drilling.

6. The method of claim 1, wherein the lateral leg support is substantially embedded in the soil when the jack-up is positioned for drilling.

7. A drilling system comprising:

a drilling platform;

at least two legs supporting said drilling platform, wherein at least one leg has a lattice framework; and a lateral support member is attached along the vertical length of the leg having the lattice framework, wherein the lateral support member partially spans a face of the leg.

8. The drilling system of claim 7, wherein said lateral support member is attached to an external face of the leg having the lattice framework, an internal face of the leg having the lattice framework and/or a vertex of the leg having the lattice framework.

9. The drilling system of claim 8, wherein said lateral support member is partially buried in the seabed when the leg having the lattice framework is deployed.

10. The drilling system of claim 8, wherein said lateral support member is totally buried in the seabed when the leg having the lattice framework is deployed.

11. A leg of a drilling platform comprising:

a body with a top base and a bottom base;

a spud can attached to the bottom base; and at least one lateral support plate attached along the vertical length of the body above the spud can wherein the leg has a lattice framework, and wherein the lateral support plate partially spans a face of the leg.

12. The leg of claim 11, wherein said lateral support plate is attached to a at least one internal face, at least one external face and/or at least one vertex of the leg.

13. The leg of claim 12, wherein said lateral support plate is partially buried when the spud can is embedded in a seabed when the leg is deployed.

14. The leg of claim 12, wherein said lateral support plate is completely buried when the spud can is embedded in the seabed when the leg is deployed.

15. An apparatus for increasing the overturning moment resistance of the apparatus wherein the apparatus comprises at least two support members, wherein each support member further comprises a lattice framework; and, wherein the lattice framework further comprises:

a plurality of vertical members wherein the plurality of vertical members are mutually parallel and spaced apart laterally to define the edges of a polyhedron in which the support member is configured;

wherein the support member further comprises at least one lateral leg support attached along a vertical length the support member;

wherein the lateral leg support partially spans a face of the support member;

wherein the support member is secured to and includes a plurality of vertical support members, a plurality of horizontal support members and/or a plurality of diagonal support members that form the open lattice framework;

wherein the plurality of vertical members are interconnected by the plurality of horizontal support members that extends between a pair of vertical members thereby forming a face; and the plurality of vertical members are further interconnected by the plurality of diagonal support members.

16. The apparatus of claim 15, wherein the polyhedron is a prism.

17. The apparatus of claim 16, wherein the prism has edges selected from a group consisting of three, four, five, six, seven, eight, nine and ten edges.

18. The apparatus of claim 15, wherein the plurality of support members form a system of internal faces and the lateral support member is attached to at least one internal face.

19. The apparatus of claim 15, wherein the plurality of support members form a system of external faces and the lateral support member is attached to at least one external face.

20. The apparatus of claim 15, wherein the lateral support member is attached to at least one vertices of the support member.

21. The apparatus of claim 15, wherein at least one lateral support member is partially and/or completely embedded in a seabed.

22. The apparatus of claim 15, wherein a combination of at least two lateral support members are attached to the support member wherein at least one lateral support member has various horizontal widths throughout the length of the lateral support member.

* * * * *